US005743758A

United States Patent [19]

Cheng et al.

[11] Patent Number: 5,743,758

[45] Date of Patent: Apr. 28, 1998

[54] LAMP SOCKET WITH A WATER AND ELECTRICITY SEALING STRUCTURE

[76] Inventors: You-Jen Cheng; Tzu-Ling Cheng, both of P.O. Box 82-144, Taipei City, Taiwan

[21] Appl. No.: 667,232

[22] Filed: Jun. 19, 1996

[51] Int. Cl.[6] ..... H01R 4/24

[52] U.S. Cl. ..... 439/419; 200/51.09; 200/51.14; 403/344; 439/277; 439/280; 439/414; 439/188

[58] Field of Search ..... 439/188, 277, 439/280, 414, 419, 602; 200/51 R, 51.01, 51.09, 51.14; 403/344, 374

[56] References Cited

U.S. PATENT DOCUMENTS

| | | | |
|---|---|---|---|
| 536,792 | 4/1895 | Sodern | 439/280 |
| 745,173 | 11/1903 | Fielding | 439/419 |
| 2,885,522 | 11/1959 | Walker | 403/344 |
| 2,985,729 | 5/1961 | Lambert | 200/51.14 |
| 5,474,467 | 12/1995 | Chen | 439/419 |
| 5,492,483 | 2/1996 | Cheng et al. | 439/419 |
| 5,526,250 | 6/1996 | Ting et al. | 439/419 |
| 5,595,493 | 1/1997 | Chen | 200/51.09 |

*Primary Examiner*—J. J. Swann
*Attorney, Agent, or Firm*—A & J

[57] ABSTRACT

A lamp socket in which the socket body is formed of two symmetrical halves connected together a dovetail joint; a rubber packing ring is mounted around the bottom lamp hole of the socket body to prohibit water from passing to the inside of the socket body after the installation of the lamp bulb; a movable metal contact plate is suspending inside the socket body and adapted for connecting the tip contact of the lamp bulb to the positive metal contact plate upon the insertion of the lamp bulb in the socket body; a spring is mounted inside the socket body to force the movable metal contact plate downwardly away from the positive metal contact plate after the removal of the lamp bulb.

3 Claims, 2 Drawing Sheets

LAMP SOCKET WITH A WATER AND ELECTRICITY SEALING STRUCTURE

BACKGROUND OF THE INVENTION

The present invention relates to lamp sockets, and relates more particularly to such a lamp socket which has a rubber packing ring mounted around the periphery of the bottom opening thereof to seal water, and a movable metal contact plate adapted for connecting the tip contact of the lamp bulb to the positive metal contact plate, and a spring adapted for imparting a downward pressure to the movable metal contact plate to force it away from the positive metal contact plate before the installation of the lamp bulb.

According to American UL and Canada CSA specifications, the center metal contact plate which contacts the tip contact of the lamp bulb must be connected to the positive (hot) wire, and the side metal contact plate which contacts the ring contact of the lamp bulb must be connected to the negative (grounded) wire. Because the side metal contact plate is disposed adjacent to the opening of the socket body and tends to be touched by fingers, it must be connected to the negative wire to prevent an electric shock. However, when a lamp socket is installed outdoors and the lamp bulb is removed, children may insert fingers into the lamp socket to touch the center metal contact plate, causing an electric shock. Furthermore, few lamp sockets have water sealing means to seal the center metal contact plate against water. When a lamp socket is installed outdoors, rain water tends to pass to the inside of the lamp socket and to wet the center metal contact plate.

SUMMARY OF THE INVENTION

The present invention has been accomplished to provide a lamp socket which eliminates the aforesaid problems.

According to one aspect of the present invention, a movable metal contact plate is mounted inside the socket body and adapted for connecting the tip contact of the lamp bulb to the positive metal contact plate, and a spring is mounted inside the socket body to impart a downward pressure to the movable metal contact plate so as to prevent direct contact of fingers to the positive metal contact plate after the removal of the lamp bulb.

According to another aspect of the present invention, a rubber packing ring is mounted around the bottom opening of the socket body so that when the lamp bulb is fastened to the socket body, the gap between the socket body and the lamp bulb is sealed to stop water from entering to the inside.

DETAILED DESCRIPTION OF THE PREFERRED EMBODIMENT

Figure 1:
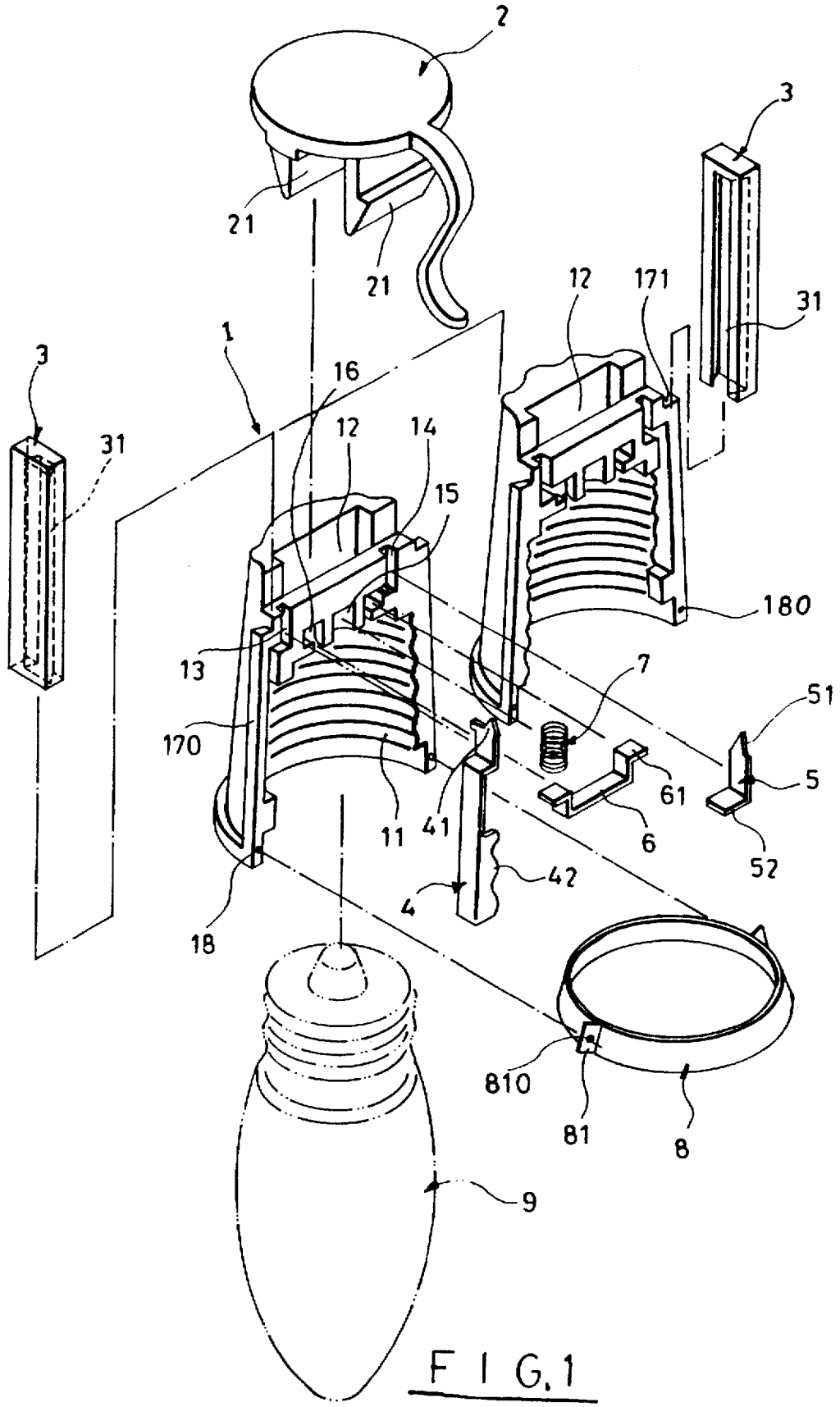
FIG. 1 is an exploded view of a lamp socket according to the present invention.
Figure 2:
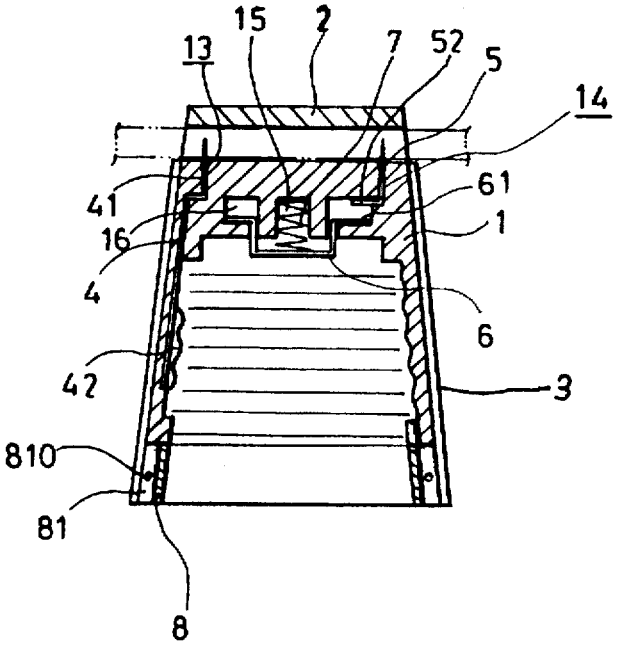
FIG. 2 is a sectional assembly view of the lamp socket shown in FIG. 1 (before the installation of the lamp bulb)

Referring to FIGS. 1 and 2, a lamp socket in accordance with the present invention is generally comprised of a socket body 1, and a socket cap 2. A negative metal contact plate 4 and a positive metal contact plate 5 are respectively mounted in the body 1. The socket body 1 comprises a negative metal contact slot 13 and a positive metal contact slot 14 respectively and perpendicularly extending from the grooved top wall to the inside and adapted for receiving the negative metal contact plate 4 and the positive metal contact plate 5 respectively, and two hook holes 12 bilaterally disposed in the grooved top wall. The socket cap 2 is fastened to the socket body 1 to hold down the electric wire into electric contact with the negative metal contact plate 4 and the positive metal contact plate 5 respectively, having two downward hooks 21 respectively hooked in the hook holes 12.

Referring to FIGS. 1 and 2 again, the socket body 1 is comprised of two symmetrical halves connected together by fitting respective pins 18 into respective pin holes 180. Each of the two halves of the socket body 1 comprises one of the aforesaid hook holes 12, one half of the aforesaid negative metal contact slot 13, and one half of the aforesaid positive metal contact slot 14. Each of the two halves of the socket body 1 further comprises two elongated flanges 170, 171 of substantially triangular cross section longitudinally raised from the periphery at two opposite sides. When the two halves of the socket body 1 are attached together, the flanges 170, 171 of the two halves of the body body 1 form two dovetail tongues, and two coupling boxes 3 are fastened to the two halves of the socket body 1 to respectively secure the flanges 170, 171 together. Each of the coupling boxes 3 has a downward dovetail groove 31 adapted for engagement with one dovetail tongue 170 or 171 of the two halves of the socket body 1. The socket body 1 further comprises a downward spring chamber 15 at the center of the inside bottom thereof, and two inside holes 16 at two opposite sides of the downward spring chamber 15. The downward spring chamber 15 and the inside holes 16 are equally formed in the two halves of the socket body 1. A movable metal contact plate 6 is transversely suspended below the downward spring chamber 15, having two opposite ends 61 respectively moved in the inside holes 16. A spring 7 is mounted in the downward spring chamber 15 to impart a downward pressure to the movable metal contact plate 6. The negative metal contact plate 4 is mounted in the negative metal contact slot 13, having a pointed upward tip 41 at the top extending out of the grooved top wall of the socket body 1 and adapted for piercing the insulator of the electric wire in the grooved top wall of the socket body 1 to make contact with one conductor thereof, and a corrugated contact surface portion 42 at the bottom adapted for engagement with the ring contact of the lamp bulb 9. The positive metal contact plate 5 is mounted in the positive metal contact slot 14 of the socket body 1, having a pointed upward tip 51 at the top extending out of the grooved top wall of the socket body 1 and adapted for piercing the insulator of the electric wire in the grooved top wall of the socket body 1 to make contact with one conductor thereof, and a horizontal contact tail 52 inserted into one inside hole 16 of the socket body 1 and suspending above one end 61 of the movable metal contact plate 6. Further, a rubber packing ring 8 is mounted in the socket body 1 at the open bottom end thereof. The rubber packing ring 8 has two outward lugs 81 raised from the periphery at two opposite sides. Each of the outward lugs 81 has a pin hole 810. Before connecting the two halves of the socket body 1, the outward lugs 81 of the rubber packing ring 8 is attached to one half of the socket body 1 and inserting the pins 18 of the respective half of the socket body 1 through the pin holes 810 of the outward lugs 81. Therefore, when the pins 18 are respectively fitted into the pin holes 180 to join the two halves of the socket body 1 together, the rubber packing ring 8 is firmly retained in the socket body 1.

Figure 3:
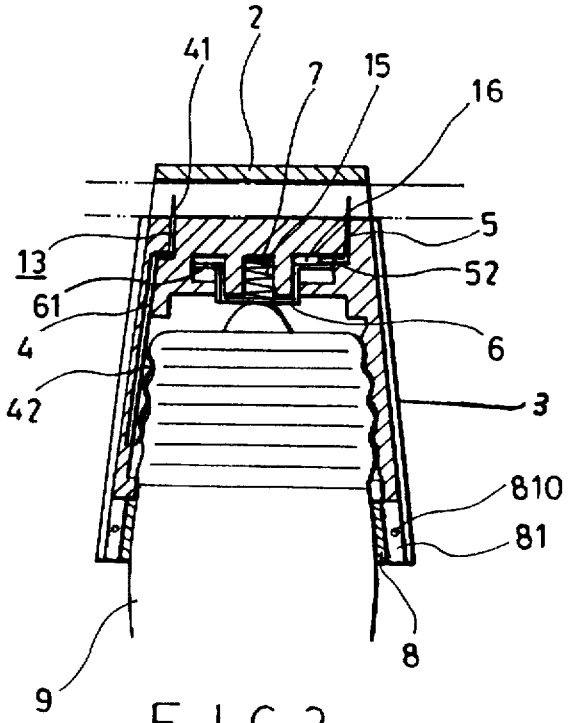
FIG. 3 is similar to FIG. 2 but showing the lamp bulb installed.

Referring to FIG. 3 and FIG. 2 again, before the installation of the lamp bulb 9, the movable metal contact plate 6 is forced downward away from the positive metal contact plate 5 by the spring 7. Because the horizontal contact tail 52 of the positive metal contact plate 5 is suspending in one inside hole 16 of the socket body 1, the positive metal contact plate 5 will not be directly touched when one inserts the fingers into the socket body 1. If one's finger touches the negative metal contact plate or the movable metal contact plate 6, no electric shock will occur. When the lamp bulb 9 is threaded into the thread 11 of the socket body 1 with its ring contact forced into engagement with the corrugated contact surface portion 42 of the negative metal contact plate 4, the tip contact of the lamp bulb 9 is forced upward against the movable metal contact plate 6, causing it to be forced into contact with the positive metal contact plate 5, and therefore the lamp bulb 9 is electrically connected. When the lamp bulb 9 is installed, the rubber packing ring 8 is closely attached to the periphery of the lamp bulb to prohibit water from passing to the inside of the socket body 1.

What the invention claimed is:

1. A lamp socket comprising a lamp socket having a grooved top wall and a bottom lamp hole, a socket cap fastened to said lamp socket to hold down an electric wire in the grooved top wall of said lamp socket, a positive metal contact plate and a negative metal contact plate mounted in respective slots in said lamp socket and having respective pointed top tips forced into contact with respective conductors in said electric wire, said socket body comprised of two symmetrical halves having respective elongated flanges at two opposite sides respectively coupled together by two dovetail-grooved coupling boxes, wherein:

a movable metal contact plate is transversely suspended inside said socket body and adapted for connecting the tip contact of the lamp bulb to said positive metal contact plate;

a spring is mounted inside said socket body to impart a downward pressure to said movable metal contact plate so as to prevent direct contact of said movable metal contact plate with said positive metal contact plate;

a rubber packing ring is mounted within said socket body around said bottom lamp hole to prohibit water from passing to the inside of said socket body after the installation of the lamp bulb.

2. The socket as claimed in claim 1, wherein said socket body comprises a spring chamber on the inside at a center point which receives said spring, two inside holes respectively disposed at two opposite sides of said spring chamber; said movable metal contact plate is suspended below said spring chamber and forced downward by said spring, having two opposite ends respectively moved in said inside holes of said socket body; said positive metal contact plate has a horizontal contact tail extending into one of said inside holes and suspending above an end of said movable metal contact plate.

3. The lamp socket as claimed in claim 1, wherein one of the symmetrical halves of said socket body has two pin holes bilaterally disposed near the bottom lamp hole of said socket body, and the other thereof having two pins bilaterally disposed near the bottom lamp hole of said socket body and respectively coupled to the pins of one half of said socket body, said outward lugs having a respective pin hole for the passing of the pins.

* * * * *